US006830492B1

(12) United States Patent
Magee et al.

(10) Patent No.: US 6,830,492 B1
(45) Date of Patent: Dec. 14, 2004

(54) MARINE DRIVE TRIM CYLINDER WITH TWO STAGE DAMPING SYSTEM

(75) Inventors: Philiip D. Magee, Stillwater, OK (US); John W. Behara, Ponca City, OK (US); Richard A. Davis, Mequon, WI (US); George E. Phillips, Oshkosh, WI (US); Wayne M. Jaszewski, Jackson, WI (US)

(73) Assignee: Brunswick Corporation, Lake Forest, IL (US)

( * ) Notice: Subject to any disclaimer, the term of this patent is extended or adjusted under 35 U.S.C. 154(b) by 0 days.

(21) Appl. No.: 10/651,571

(22) Filed: Aug. 29, 2003

(51) Int. Cl.[7] ..... B63H 20/08
(52) U.S. Cl. ..... 440/61 R; 267/220
(58) Field of Search ..... 440/52, 61 R, 440/61 T; 267/141, 153, 219, 220; 188/321.11

(56) References Cited

U.S. PATENT DOCUMENTS

| | | | | | |
|---|---|---|---|---|---|
| 3,770,232 | A | | 11/1973 | Blake | 248/21 |
| 5,044,598 | A | | 9/1991 | Mann et al. | 248/638 |
| 5,172,894 | A | | 12/1992 | Hein et al. | 267/140 |
| 5,242,146 | A | | 9/1993 | Tecco et al. | 248/638 |
| 5,295,670 | A | * | 3/1994 | Tsukamoto et al. | 267/140.5 |
| 5,707,263 | A | | 1/1998 | Eick et al. | 440/61 |
| 5,794,742 | A | * | 8/1998 | Lack et al. | 188/321.11 |
| 6,123,620 | A | | 9/2000 | Polakowski | 464/73 |
| 6,280,268 | B1 | | 8/2001 | Nishi et al. | 440/61 |
| 6,287,159 | B1 | | 9/2001 | Polakowski et al. | 440/52 |
| 6,309,264 | B1 | | 10/2001 | Saito | 440/56 |
| 6,419,534 | B1 | | 7/2002 | Helsel et al. | 440/52 |

* cited by examiner

*Primary Examiner*—Ed Swinehart
(74) *Attorney, Agent, or Firm*—William D. Lanyi

(57) ABSTRACT

A two stage damping system is provided for a trim cylinder mount of a marine drive unit. The mounting bushings comprise inner and outer tubes with an elastomeric material disposed between the inner and outer tubes. The elastomeric material is structured to provide a soft rate of stiffness in response to relatively light loads, such as shifting loads, and a harder rate of stiffness in response to higher loads, such as during high thrust loads or wide open throttle operation of a marine vessel. The two rates of stiffness are provided by the appropriate placement of cavities either within the elastomeric material or between the elastomeric material and the inner or outer tubes. Alternatively, two different types of elastomeric material can be used to provide the two rates of stiffness.

20 Claims, 4 Drawing Sheets

MARINE DRIVE TRIM CYLINDER WITH TWO STAGE DAMPING SYSTEM

BACKGROUND OF THE INVENTION

1. Field of the Invention

The present invention is generally related to a mounting system for a marine propulsion device and, more particularly, to a mounting system that exhibits two different degrees of stiffness in response to different ranges of force magnitude imposed on the system.

2. Description of the Prior Art

Many different types of mounting systems are well known to those skilled in the art. Typically, a mounting system which is intended to isolate vibration and prevent it from being transmitted along a structure comprises an elastomeric material, such as rubber, in combination with inelastic materials, such as metal or hard polymer materials.

U.S. Pat. No. 5,242,146, which issued to Tecco et al on Sep. 7, 1993, describes an engine mount having an improved vibration isolation capability. The mount is intended for the purpose of mounting an automotive vehicle engine to the automotive vehicle chassis. The mount comprises a vibration isolator portion which is designed with relatively low stiffness to provide increased vibration isolation. Excessive displacements are avoided by snubbers. Snubbing action in one direction is provided by a circular snubber that is disposed in spaced relation to the vibration isolator portion. Snubbing action in other directions is provided by the particular design of the vibration isolator portion. Embodiments of both a front and a rear engine mount are provided.

U.S. Pat. No. 5,172,894, which issued to Hein et al on Dec. 22, 1992, describes a dual elastomeric/fluid engine mount. The engine mount is described as having two concentrically disposed annular resilient rubber springs, the outermost of which is provided with a pair of cavities and connecting passageway for receiving a dampening fluid. The spring rates of the two rubber springs can be individually tuned by the use of voids or cavities. Thus, there is a threefold manner in which the spring rate of the engine mount can be tuned.

U.S. Pat. No. 5,044,598, which issued to Mann et al on Sep. 3, 1991, describes a resilient motor mounting structure. The motor mount is suitable for use as a vibrational isolating motor mount. The mount connects the motor to a support structure by using a support fixture and a motor stud separated by a flexible member. A plurality of portions of the flexible member surround the support fixture and motor stud to lessen vibrational transfer from the motor to the structure fixture and to lessen metal fatigue caused by metal to metal contact.

U.S. Pat. No. 3,770,232, which issued to Blake on Nov. 6, 1973, describes a shock and vibration isolation mount. The mount includes a resilient elastomeric portion coupled in shock attenuating series with a stacked plurality of dished, disc-shaped annular metal springs. Normal low level vibration is attenuated by the resilient elastomeric portion acting alone, whereas high intensity shocks of sufficient magnitude to compress the resilient elastomeric portion to a substantially incompressible form of near infinite spring constant are continually attenuated by the stacked metal springs.

U.S. Pat. No. 6,419,534, which issued to Helsel et al on Jul. 16, 2002, discloses a structural support system for an outboard motor. The systems is provided for an outboard motor which uses four connectors attached to a support structure and to an engine system for isolating vibration from being transmitted to the marine vessel to which the outboard is attached. Each connector comprises an elastomeric portion for the purpose of isolating the vibration. Furthermore, the four connectors are disposed in a common plane which is generally perpendicular to a central axis of a driveshaft of the outboard motor. Although precise perpendicularity with the driveshaft axis is not required, it has been determined that if the plane extending through the connectors is within forty-five degrees of perpendicularity with the driveshaft axis, improved vibration isolation can be achieved. A support structure, or support saddle, completely surrounds the engine system in the plane of the connectors. All of the support of the outboard motor is provided by the connectors within the plane with no additional support provided at a lower position on the outboard motor driveshaft housing.

U.S. Pat. No. 6,123,620, which issued to Polakowski on Sep. 26, 2000, discloses a multirate coupler with improved vibration isolation capability. A coupler is provided which responds to relative rotation of a driving and a driver shaft with variable rates of stiffness. As the two shafts experience slight degrees of relative rotation, such as at idle speed, the elastically deformable member of the coupler responds in a relatively soft manner with a slight degree of stiffness. As relative rotation increases because of the transmission of higher torque between the driving and driven shafts, the elastically deformable member responds with a stiffer reaction. The elastically deformable member also reacts in a similar manner with differing rates of stiffness to misalignment of the driving and driven shafts.

U.S. Pat. No. 6,287,159, which issued to Polakowski et al on Sep. 11, 2001, discloses a marine propulsion device with a compliant isolation mounting system. A support apparatus for a marine propulsion system in a marine vessel is provided with a compliant member that is attachable to the transom of a marine vessel. In certain applications, the compliant member is directly attached to an intermediate plate and to an external frame member that is, in turn, attached directly to the transom of the marine vessel. The intermediate plate is attached directly to components of the marine propulsion system to provide support for the marine propulsion system relative to the transom, but while maintaining non-contact association between the marine propulsion and the transom.

U.S. Pat. No. 5,707,263, which issued to Eick et al on Jan. 13, 1998, discloses an adjustable trim position system. A system for a trimable marine stern drive shifts the trimable range on a conventional hydraulic trim system. The system includes an enlarged cylinder anchor pin hole in the drive shaft housing, an anchor pin smaller in size than the enlarged pin hole located in the in the drive shaft housing, and a movable trim adjustment insert that is inserted into the enlarged anchor pin hole to secure the anchor pin in a fixed position within the enlarged hole. It is preferred that the enlarged anchor pin hole be a substantially horizontal elongated hole, and that the trim adjustment insert be placed rearward of the anchor pin to position the anchor pin in a forward position, or forward of the anchor pin to locate the anchor pin in a rearward direction. The invention shifts the trimable range of the drive, while maintaining vibration isolation characteristics available in conventional hydraulic trim systems.

U.S. Pat. No. 6,309,264, which issued to Saito on Oct. 30, 2001, describes a cylinder assembly for a marine propulsion unit. An improved hydraulic cylinder arrangement for a marine propulsion unit permits primarily effective tilt and trim movement through a compound tilt and trim cylinder. At least one first shock absorber valve is provided on a tilt piston and at least one second shock absorber valve is provided on a tilt cylinder that acts as a trim piston in a trim adjusted range operation. In another feature of the invention, a filter is disposed upstream of the second shock absorber valve.

U.S. Pat. No. 6,280,268, which issued to Nishi et al on Aug. 28, 2001, describes a tilt device for a marine propulsion unit. A tilt device for a marine propulsion unit is disclosed where a shock blow valve comprises a disk valve fixed to a valve seat surface of the piston, the valve seat surface being provided with a seal member surrounding a communication hole which opens at the valve seat surface, and the disk valve is tightly connected to the seat member.

The patents described above are hereby expressly incorporated by reference in the description of the present invention.

Various types of elastomeric mounting systems are well known to those skilled in the art. Marine stem drive systems are also well known to those skilled in the art. In addition, skilled artisans are aware of numerous types of hydraulic and piston cylinder combinations that can be used to move marine stem drive systems for the purpose of achieving desired trim and/or tilt positions.

In certain marine drive applications, a temporary impact is experienced during shifting procedures. As the transmission of the marine propulsion system is changed from neutral to forward or from neutral to reverse, an impact force is experienced as the drive system attempts to initiate movement of a stationary marine propeller. This impact can be sensed by the operator of a marine vessel because the shock forces are transmitted through the structure of the marine drive through the hydraulic cylinders used for trim and tilt, and into the transom of the marine vessel. Unfortunately, if soft resilient mounts are used to isolate this shock force, the steering and handling capabilities of the marine vessel can be severely and deleteriously affected. It would therefore by significantly beneficial if a system could be devised that isolates the shock forces associated with shifting while providing sufficient stiffness so as to avoid adverse effects on steering and handling of the marine vessel.

SUMMARY OF THE INVENTION

A marine propulsion system made in accordance with the preferred embodiment of the present invention comprises a marine drive unit, a hydraulic device attached to the marine drive unit and attachable to a marine vessel, and a vibration damping device attached between the marine drive unit and a first end of the hydraulic device. The hydraulic device has a first end attached to the drive unit and a second end which is attachable to the marine vessel. The vibration dampingdevice has a first rate of stiffness in response to a first magnitude of load and a second rate of stiffness in response to a second magnitude of load, whereas the second magnitude of load in greater than the first magnitude of load.

The vibration damping device comprises an outer tube, an inner tube, an elastomeric material disposed between the outer and inner tubes. The vibration damping device is attached to the first end of the hydraulic device. The outer tube is attached to the first end of the hydraulic device in a preferred embodiment, but the inner tube can also be attached to the first end of the hydraulic device in alternative embodiments.

The second rate of stiffness is greater than the first rate of stiffness and the first rate of stiffness is softer than the second rate of stiffness because of at least one cavity formed in the elastomeric material.

In a preferred embodiment, the outer tube is made of metal which can be stainless steel. Similarly, the inner tube is made of metal in a preferred embodiment and can be made of stainless steel. In one embodiment of the present invention, the inner tube is bonded to the elastomeric material and the outer tube is bonded to the elastomeric material. In an alternative embodiment, the elastomeric material is disposed in unbonded relation between the inner and outer tubes. Also, it should be understood that either one or both of the inner and outer tubes can be bonded to the elastomeric material or, alternatively, both the inner and outer tube can be unbonded to the elastomeric material.

BRIEF DESCRIPTION OF THE DRAWINGS

The present invention will be more fully and completely understood from a reading of the description of the preferred embodiment in conjunction with the drawings, in which.

DESCRIPTION OF THE PREFERRED EMBODIMENT

Figure 1:
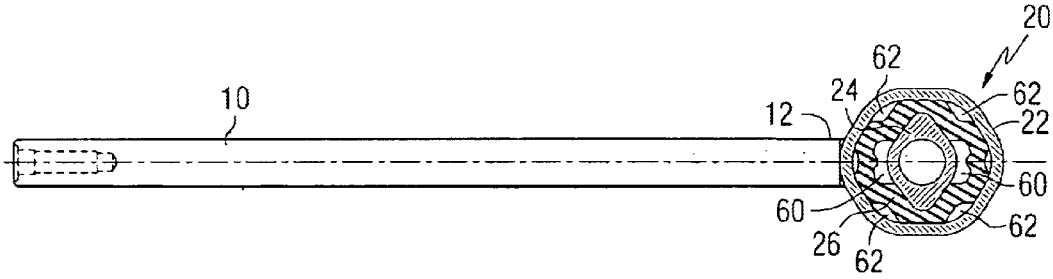
FIG. 1 is a section view of a vibration damping device made in accordance with the present invention and connected to a hydraulic trim device.

Throughout the description of the preferred embodiment of the present invention, like components will be identified by like reference numerals.

Certain stern drive systems exhibit shifting characteristics that result in an impact force experienced by the drive unit when the transmission moves from neutral into either forward or reverse gear positions. This impact force can be transmitted through the hydraulic cylinders that are used to provide trim and tilt capabilities for the drive unit. The impact force, or shock, can therefore be transmitted into the transom of the marine vessel and, in turn, to the operator of the marine vessel. The impact force results from the abrupt direction/speed change experienced by the marine propeller. It creates a thrust spike into the transom because of the shock transmission provided by the hydraulic trim/tilt cylinders.

If a soft elastomeric material is used in the trim cylinder mounting bushings, this impact force is reduced. However, the use of a soft elastomeric material in the mounting bushings can have a detrimental effect on the steering and handling characteristics of the marine vessel. If, on the other hand, the elastomeric material is too stiff, the impact force resulting from shifting is transmitted through the mounting bushing to the transom of the marine vessel.

The present invention is intended to significantly isolate the shock forces resulting from shifting while providing sufficient stiffness in response to higher loads that occur during handling and steering operations.

FIG. 1 shows a portion of a trim cylinder which incorporates the characteristics of the present invention. The rod 10 is attached to a piston (not shown in FIG. 1) of a hydraulic cylinder. The rod has a first end 12 which is attached to a marine drive unit, as will be illustrated and discussed below, and a second end which is attachable to a marine vessel. The second end of the hydraulic cylinder is not shown in FIG. 1. A vibration damping device 20 is attached between the marine drive unit (not shown in FIG. 1) and the first end 12 of the hydraulic device which comprises the rod 10 attached to a piston of a hydraulic cylinder. The vibration damping device 20 has a first rate of stiffness in response to a first magnitude of load and a second rate of stiffness in response to a second magnitude of load, the second magnitude of load being greater than the first magnitude of load. The vibration damping device 20 comprises an outer tube 22, an inner tube 24, and an elastomeric material 26 disposed the outer and inner tubes, 22 and 24. The vibration damping device 20 is attached to the first end 12 of the hydraulic device. More specifically, the outer tube 22 is attached to the first end 12 of the hydraulic device in a particularly preferred embodiment, as shown in FIG. 1. It should be understood that alternate configurations and embodiments of the present invention can connect the first end 12 to the inner tube 24.

Figure 2:
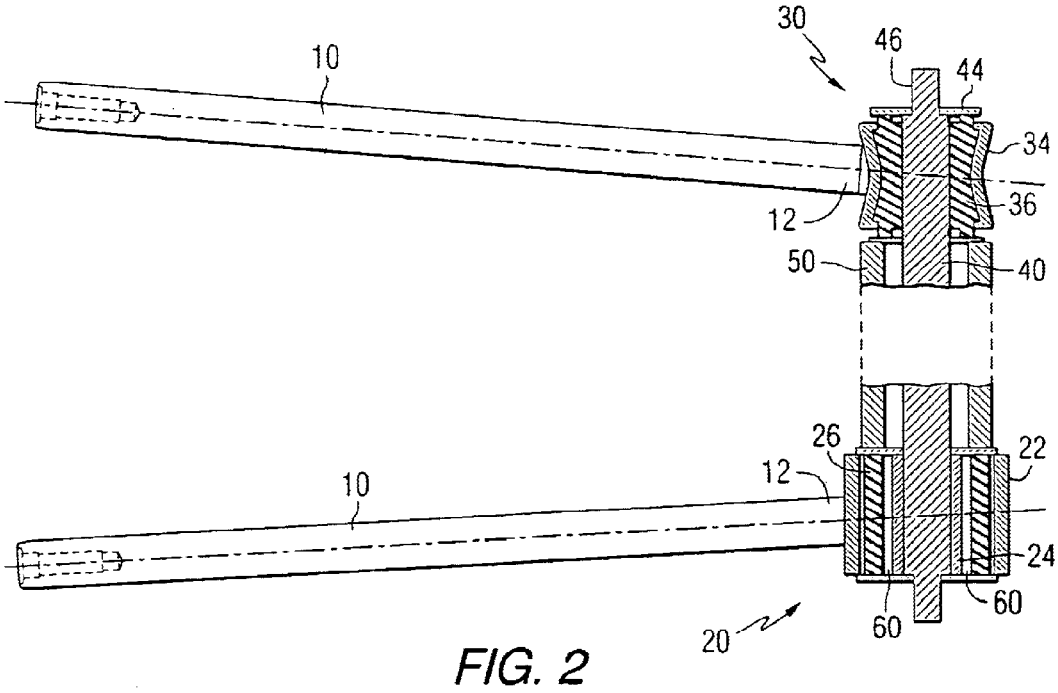
FIG. 2 is a composite illustration showing a known type of vibration damping device in combination with one made in accordance with the present invention.

FIG. 2 shows a known type of trim cylinder mounting bushing hypothetically shown in combination with a vibration damping device 20 made in accordance with the present invention. It should be clearly understood that the combination shown in FIG. 2 is hypothetical and used only for the purpose of demonstrating the differences between the known type of coupling 30 and the present invention 20. In the known type of coupling 30, an outer tube 34 is used to contain an elastomeric material 36. The elastomeric material 36 is shaped so that a central shaft 40 can be disposed therethrough. An outer washer 44 is used to hold the bushing 30 in place after a nut is installed at the end 46 of the shaft 40. The elastomeric material 36, in a known type of trim cylinder bushing exhibits a single magnitude of stiffness, or rate of resilience, under most conditions experienced by the marine drive. In FIG. 2, reference numeral 50 is used to identify a component that is rigidly attached to the marine drive unit. For purposes of clarity and simplicity, the component identified by reference numeral 50 is not shown in the precise shape that it would appear in all embodiments.

With continued reference to FIG. 2, the vibration damping device 20 of the present invention comprises the outer tube 22, the inner tube 24, the elastomeric material 26, and a plurality of cavities 60 that allow it to perform with the characteristics of two rates of stiffness. These cavities can be in several different positions. With reference to FIG. 1, cavities 60 are located in the region between the inner tube 24 and the elastomeric material 26. Other cavities 62, are located between the elastomeric material 26 and the outer tube 22. The advantages provided by these cavities, 60 and 62, will be described in greater detail below.

Figure 3:
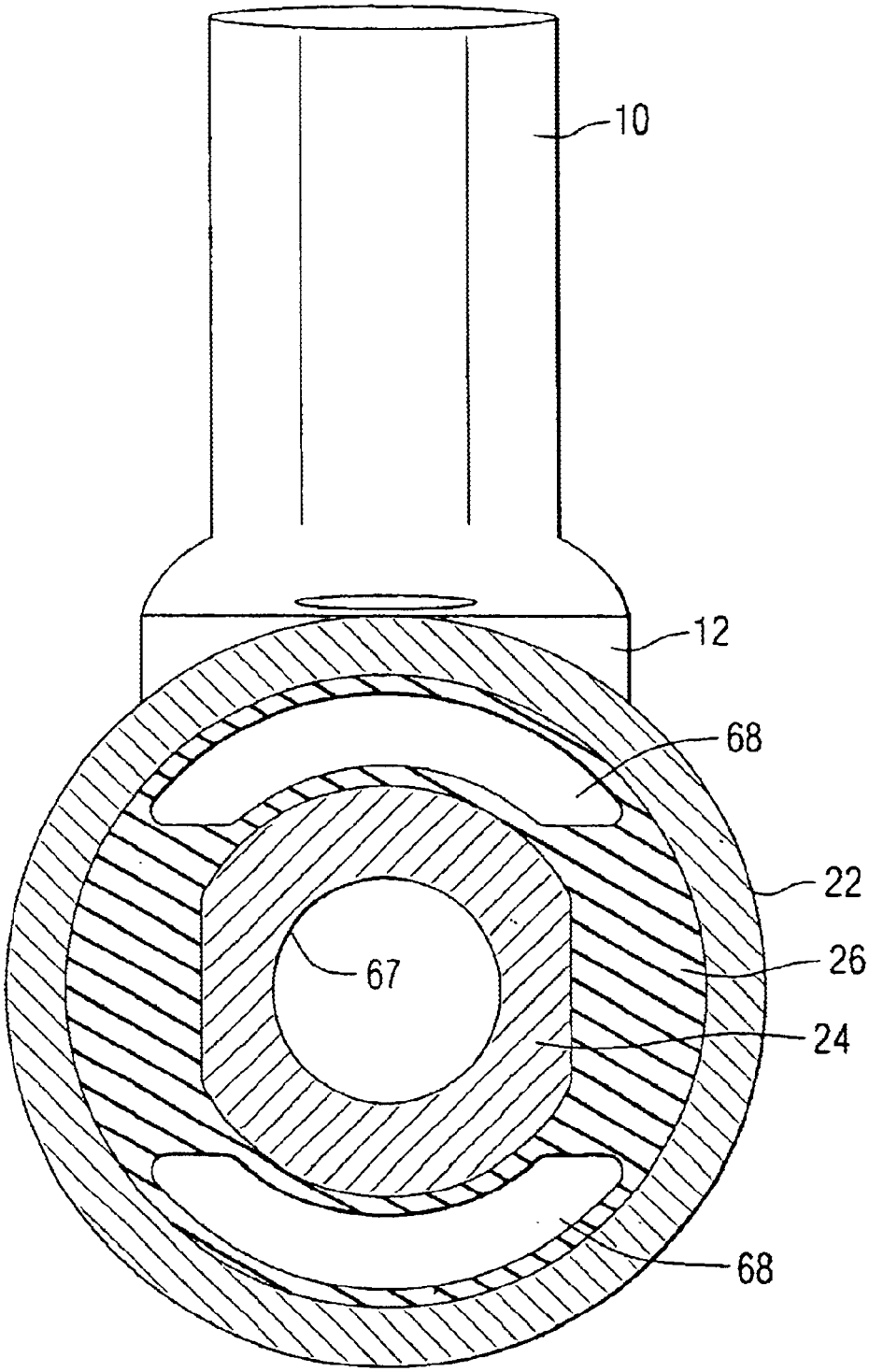
FIG. 3 shows an embodiment of the present invention in which cavities are provided within the structure of an elastomeric member.

FIG. 3 shows a slightly difference embodiment of the present invention. The outer tube 22 is attached to the first end 12 of the rod 10 in the manner described above. In addition, the inner tube 24 is shaped to have a central opening 67 that is shaped to receive the rod 40 which is described above in conjunction with FIG. 2. In the embodiment shown in FIG. 3, cavities 68 are formed within the structure of the elastomeric material 26 and are not specifically located between the elastomeric material 26 and either the inner tube 24 or the outer tube 22. Instead, the cavities 68 are contained totally within the elastomeric material 26.

Figure 4A:
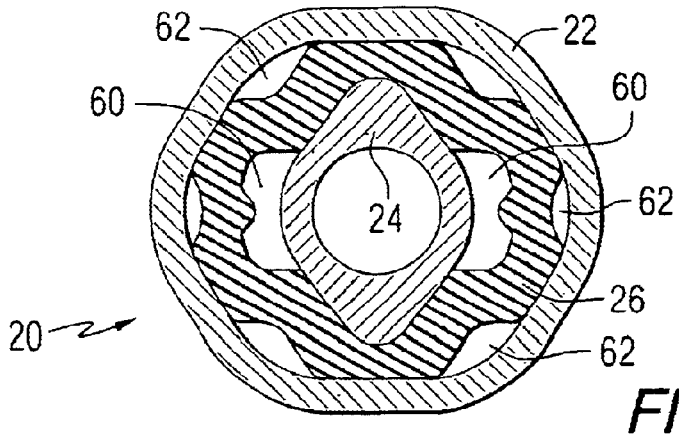
FIGS. 4A–4C show the sequential relative movement between the inner and outer tubes of the present invention in response to difference magnitudes of load.
Figure 4B:
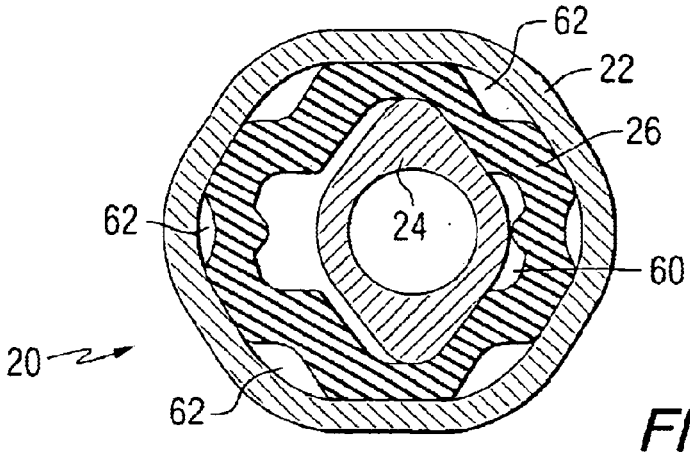
Figure 4C:
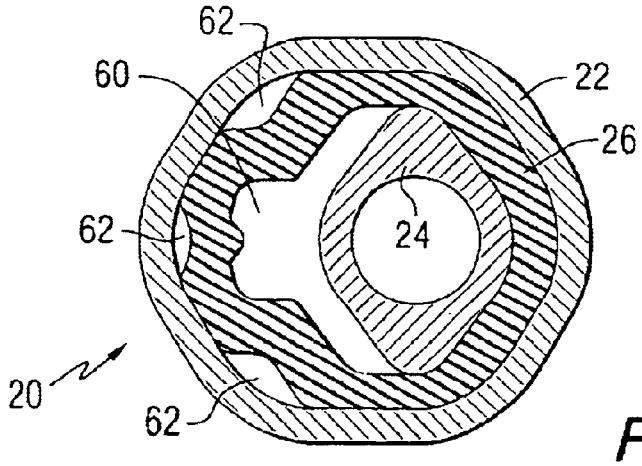

FIGS. 4A–4C are intended to show the consequential positions of the components of the present invention in response to a force imposed on the vibration damping device 20. The illustration in FIG. 4A represents the relative positions of the inner 24 and outer 22 tubes when the marine drive is under either no load or a very light load. In other words, nothing is causing the inner and outer tubes to move relative to each other. In FIG. 4A, cavities 60 are shown between the elastomeric material 26 and the inner tube 24, as illustrated in FIG. 1.

FIG. 4B shows the results of a relatively slight force, such as that which is experienced during the shifting operation. Because of the structure and position of cavities 60, the inner tube 24 is able to move relative to the outer tube 22 with relative ease because the cavities 60 create a relatively soft rate of stiffness in the elastomeric material 26 during the initial relative movement between the inner and outer tubes, 24 and 22. Therefore, the vibration damping device 20 is able to isolate the forces associated with the shifting loads and prevent them from being transmitted through the hydraulic trim/tilt device which comprises rod 10, as described above in conjunction with FIGS. 1–3.

FIG. 4C shows the relative positions of the outer and inner tubes, 22 and 24, in response to a significantly higher magnitude of load, such as during wide open throttle or high thrust operation of the boat. As can be seen, the inner tube 24 has moved farther toward the right, relative to the outer tube 22, as compared to FIGS. 4A and 4B. In fact, the cavities, 60 and 62, on the right side of the vibration damping device 20 have essentially disappeared because of the compression of the elastomeric material 26 between the right sides of the inner tube 24 and outer tube 22. When these higher magnitudes of load are removed from the device, the resiliency of the elastomeric material 26 will return the inner tube 24 to its position shown in FIG. 4A relative to the outer tube 22.

With continued reference to FIGS. 4A–4C, it should be understood that the primary advantage of the present invention is that it exhibits two different rates of resiliency or stiffness. A first rate is softer than the second rate because of the presence of the cavities, 60 and 62. During relatively light loads, such as during shifting, the softer rate of stiffness of the elastomeric stiffness material 26 allows the inner tube 24 to move as shown in FIG. 4B relative to the outer tube 22 with less resistance provided by the elastomeric material 26 than is the case when higher loads are experienced. During high thrust operation of the marine vessel, much higher loads are experienced, in comparison to shifting loads, and the inner tube 24 is resisted by the elastomeric material 26 with a harder degree of stiffness than during the initial relative movement between the inner and outer tubes, as can be seen by comparing FIGS. 4A and 4B. When the additional higher loads are experienced, the movement from the positions shown in FIG. 4B and FIG. 4C is resisted with a higher rate of stiffness by the elastomeric material 26. This dual rate of stiffness provides significant advantages in marine drive applications because it isolates lesser magnitudes of load, such as during shifting operations, while resisting higher magnitudes of load to allow proper handling and maneuvering without the sluggishness and variability that would be experienced if the elastomeric material was provided with a low, or soft rate of stiffness during all magnitudes of loads.

Figure 5:
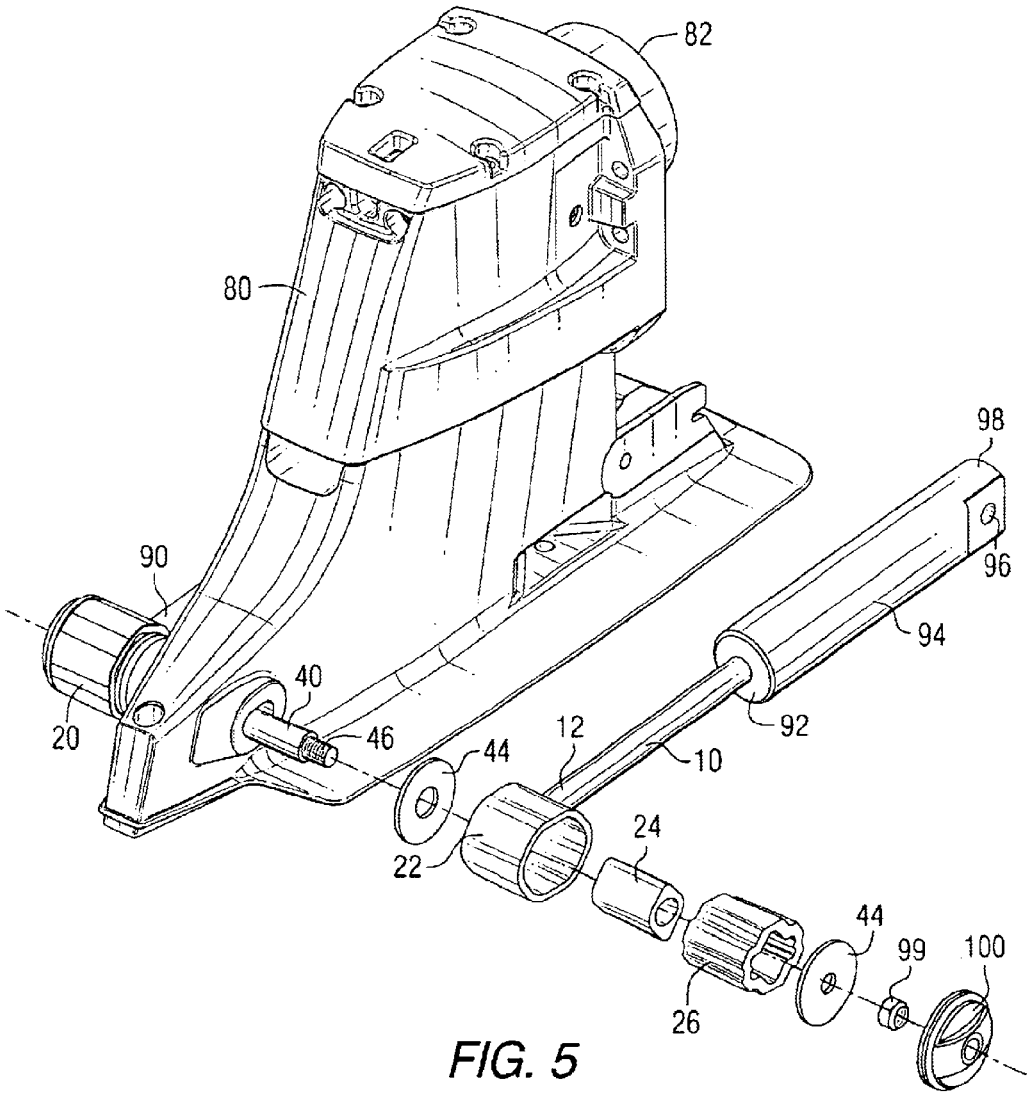
FIG. 5 is an isometric exploded view of the present invention used in conjunction with the marine drive unit.

FIG. 5 is an exploded isometric view of a marine drive unit 80. It should be understood that, although the transom of the marine vessel is not shown in FIG. 5, the drive unit 80 is attachable to a transom with the tubular structure 82 extending into an opening formed in the transom of a marine vessel to allow a drive shaft to extend therethrough. This association of the marine drive 80, known as a stem drive unit, and a marine vessel is well known to those skilled in the art and will not be described in detail herein.

In FIG. 5, one trim cylinder 90 is shown on the far side of the drive 80 in an assembled configuration. The other trim cylinder 92 is shown in an exploded view to illustrate the relative positions of the components of the present invention. It should be understood that both trim cylinders, 90 and 92, are identical to each other in both construction and function. The rod 10 of the hydraulic device is attached to a piston contained within a cylinder 94. The trim cylinder, which comprises the cylinder 94, a piston within the cylinder 94, and the rod 10 which is attached to the piston, is well known to those skilled in the art. It is attached, in conjunction with hole 96, in a pivotable manner to the transom of the marine vessel. As a result, the second end 98 of the hydraulic device 92 is attachable to the marine vessel through the use of the hole 96.

With continued reference to FIG. 5, it should be understood that the elastomeric material 26 can be bonded to either one or both the inner tube 24 and the outer tube 22 or, alternatively, can be more loosely fitted between these two components. The action demonstrated in the sequential illustrations of FIGS. 4A–4C show the effect of an unbonded association, with the elastomeric material being disposed more loosely between the inner and outer tubes, 24 and 22. Alternatively, the elastomeric material 26 can be rigidly bonded to both the inner and outer tubes. These are alternative possibilities of the present invention, which can be selected as a function of the intended rates of stiffness and other considerations. Although the present invention has been described in terms of a preferred embodiment in which the vibration damping device 20 is located proximate the first end of the first end 12 of the hydraulic device 92, it should be understood that the advantages of the present invention can also be realized when the vibration damping device is located proximate the second end 98. Similarly, the vibration damping device can be located within the drive unit 80. The important aspect of the construction is that the vibration damping device be located within the path of force between the drive unit and the portion of the marine vessel to which the second end 98 is attachable. This provides the damping advantage which is provided by the present invention.

With reference to FIGS. 1–5, it can be seen that the present invention comprises a marine drive unit 80, a hydraulic device 92, and a vibration damping device 20. The hydraulic device 92 is attached to the marine drive unit 80 and is attachable to a marine vessel. The hydraulic device 92 has a first end 12 which is attached to the marine drive unit 80 and a second end 98 which is attachable to the marine vessel. The vibration damping device 20 is attached between the marine drive unit 80 and the first end 12 of the hydraulic device 92. The vibration damping device 20 has a first rate of stiffness in response to a first magnitude of load, such as shifting loads, and a second rate of stiffness in response to a second magnitude of load, such as steering and maneuvering loads, with the second magnitude of load being greater than the first magnitude of load. The vibration damping device 20 comprises an outer tube 22, an inner tube 24, and an elastomeric material 26 disposed between the outer and inner tubes, 22 and 24. The vibration damping device 20 is attached to the first end 12 of the hydraulic device 92. The outer tube 22 is attached to the first end 12 of the hydraulic device. The inner tube 24 can be attached to the first end 12 of the hydraulic device 92 if appropriate structure is provided. The second rate of stiffness, in response to higher thrust loads is stiffer than the first rate of stiffness in response to shifting loads. The different rates of stiffness result from the cavities formed in or adjacent to the elastomeric material 26. The outer tube 22 can be made of metal and, more particularly, stainless steel. Similarly, the inner tube 24 can be made of metal and, more particularly, stainless steel. The inner tube 24 can be bonded to the elastomeric material 26. The outer tube 22 can also be bonded to the elastomeric material 26. Alternatively, the elastomeric material 26 can be disposed in unbonded relation between the inner and outer tubes, 24 and 22. Two washers can be used to contain the assembly between them when the trim cylinder 92 is attached to the rod 40 which, in turn, is attached to the drive unit 80. In order to hold the first end 12 of the hydraulic device 92 in place on the rod 40, a nut 99 and cover 100 can be used.

Although the present invention has been described in particular detail and illustrated to show a preferred embodiment, it should be understood that alternative embodiments are also within its scope.

We claim:

1. A marine propulsion system, comprising:

a marine drive unit;

a hydraulic device attached to said marine drive unit and attachable to a marine vessel, said hydraulic device having a first end attached to said marine drive unit and a second end which is attachable to said marine vessel; and a vibration damping device attached between said marine drive unit and a portion of said marine vessel to which said second end is attachable, said vibration damping device having a first rate of stiffness in response to a first magnitude of load and a second rate of stiffness in response to a second magnitude of load, said second magnitude of load is greater than said first magnitude of load.

2. The marine propulsion system of claim 1, wherein:

said vibration damping device comprises an outer tube, an inner tube, and an elastomeric material disposed between said outer and inner tubes.

3. The marine propulsion system of claim 1, wherein:

said vibration damping device is attached to said first end of said hydraulic device.

4. The marine propulsion system of claim 2, wherein:

said outer tube is attached to said first end of said hydraulic device.

5. The marine propulsion system of claim 2, wherein:

said inner tube is attached to said first end of said hydraulic device.

6. The marine propulsion system of claim 1, wherein:

said second rate of stiffness is stiffer than said first rate of stiffness.

7. The marine propulsion system of claim 1, wherein:

said first rate of stiffness is softer than said second rate of stiffness because of at least one cavity formed in said elastomeric material.

8. The marine propulsion system of claim 2, wherein:

said outer tube is made of metal.

9. The marine propulsion system of claim 2, wherein:

said inner tube is made of metal.

10. The marine propulsion system of claim 2, wherein:

said outer tube is made of stainless steel.

11. The marine propulsion system of claim 2, wherein:

said outer tube is made of stainless steel.

12. The marine propulsion system of claim 2, wherein:

said inner tube is bonded to said elastomeric material.

13. The marine propulsion system of claim 2, wherein:

said outer tube is bonded to said elastomeric material.

14. The marine propulsion system of claim 2, wherein:

said elastomeric material is disposed in unbonded relation between said inner and outer tubes.

15. A marine propulsion system, comprising:

a marine drive unit;

a hydraulic device attached to said marine drive unit and attachable to a marine vessel, said hydraulic device having a first end attached to said marine drive unit and a second end which is attachable to said marine vessel; and a vibration damping device attached between said marine drive unit and a portion of said marine vessel to which said second end is attachable, said vibration damping device having a first rate of stiffness in response to a first magnitude of load and a second rate of stiffness in response to a second magnitude of load, said second magnitude of load is greater than said first magnitude of load, said vibration damping device comprising an outer tube, an inner tube, and an elastomeric material disposed between said outer and inner tubes, said vibration damping device being attached to said first end of said hydraulic device, said second rate of stiffness being stiffer than said first rate of stiffness.

16. The marine propulsion system of claim 15, wherein:

said outer tube is attached to said first end of said hydraulic device.

17. The marine propulsion system of claim 15, wherein:

said first rate of stiffness is softer than said second rate of stiffness because of at least one cavity formed in said elastomeric material.

18. The marine propulsion system of claim 17, wherein:

said inner and outer tube are made of stainless steel.

19. The marine propulsion system of claim 18, wherein:

said inner tube and said outer tube are both bonded to said elastomeric material.

20. A marine propulsion system, comprising:

a marine drive unit;

a hydraulic device attached to said marine drive unit and attachable to a marine vessel, said hydraulic device having a first end attached to said marine drive unit and a second end which is attachable to said marine vessel; and a vibration damping device attached between said marine drive unit and said first end of said hydraulic device, said vibration damping device having a first rate is of stiffness in response to a first magnitude of load and a second rate of stiffness in response to a second magnitude of load, said second magnitude of load is greater than said first magnitude of load, said vibration damping device comprising an outer tube, an inner tube, and an elastomeric material disposed between said outer and inner tubes, said vibration damping device being attached to said first end of said hydraulic device, said second rate of stiffness being stiffer than said first rate of stiffness, said outer tube being attached to said first end of said hydraulic device, said first rate of stiffness being softer than said second rate of stiffness because of at least one cavity formed in said elastomeric material, said inner and outer tube being made of stainless steel, said inner tube and said outer tube being both bonded to said elastomeric material.

* * * * *